US008206065B2

(12) United States Patent
Heselden

(10) Patent No.: US 8,206,065 B2
(45) Date of Patent: Jun. 26, 2012

(54) GABION

(75) Inventor: James Heselden, Leeds (GB)

(73) Assignee: Hesco Bastion Limited, Leeds, Yorkshire (GB)

( * ) Notice: Subject to any disclaimer, the term of this patent is extended or adjusted under 35 U.S.C. 154(b) by 247 days.

(21) Appl. No.: 12/513,643

(22) PCT Filed: Jan. 8, 2008

(86) PCT No.: PCT/EP2008/050149
§ 371 (c)(1), (2), (4) Date: May 28, 2009

(87) PCT Pub. No.: WO2008/087073
PCT Pub. Date: Jul. 24, 2008

(65) Prior Publication Data

US 2010/0064627 A1 Mar. 18, 2010

(30) Foreign Application Priority Data

Jan. 19, 2007 (GB) ..... 0701053.1
Mar. 5, 2007 (GB) ..... 0704212.0

(51) Int. Cl.
*E02D 29/02* (2006.01)

(52) U.S. Cl. ..... 405/284; 405/258.1; 405/15; 405/17

(58) Field of Classification Search ..... 405/15, 405/16, 17, 21, 30, 31, 33, 34, 35, 258.1, 405/284, 286, 287, 287.1
See application file for complete search history.

(56) References Cited

U.S. PATENT DOCUMENTS 5,076,735 A * 12/1991 Hilfiker ..... 405/284
5,472,297 A * 12/1995 Heselden ..... 405/286
5,636,938 A * 6/1997 Ragazzo ..... 405/15
(Continued)

FOREIGN PATENT DOCUMENTS

EP 0620326 A1 4/1990
(Continued)

OTHER PUBLICATIONS

International Search Report; International Preliminary Report on Patentability; Written Opinion of the International Searching Authority (International Application No. PCT/EP/2008/050149 filed Jan. 8, 2008).

(Continued)

*Primary Examiner* — Frederick L Lagman
(74) *Attorney, Agent, or Firm* — Ping Wang; Andrews Kurth, LLP

(57) ABSTRACT

A recoverable gabion is disclosed. The gabion comprises opposed side walls connected together at spaced intervals by a plurality of partition walls such that spaces between neighboring pairs of partition walls define, together with the side walls, individual compartments of the gabion, adjacent side and partition walls being connected to one another by pivotal connections wherein at least one partition wail comprises at least three partition wall elements, a first partition wall element being pivotally connected to a first side wall and a second partition wall element being connected to a second side wall, and the partition wall comprising at least a third partition wall element between said first and second partition wall elements acting as a spacer element therebetween to extend the width of the gabion compartment and being releasably connected to the first and second partition wall elements.

22 Claims, 6 Drawing Sheets

U.S. PATENT DOCUMENTS

| | | | | |
|---|---|---|---|---|
| 7,854,574 | B2 * | 12/2010 | Heselden | 405/284 |
| 2008/0247830 | A1 * | 10/2008 | Heselden | 405/273 |
| 2008/0279634 | A1 * | 11/2008 | Heselden | 405/284 |
| 2010/0143049 | A1 * | 6/2010 | Heselden | 405/284 |
| 2011/0033236 | A1 * | 2/2011 | Heselden | 405/15 |

FOREIGN PATENT DOCUMENTS

| | | | |
|---|---|---|---|
| JP | 08134868 | A1 | 5/1996 |
| JP | 2005060991 | A | 3/2005 |
| WO | 0040810 | A1 | 7/2000 |

OTHER PUBLICATIONS

GB Search Report (GB Application No. 0701053.1 filed Jan. 19, 2007).

GB Search Report (GB Application No. 0704212.0 filed Mar. 15, 2007).

* cited by examiner

GABION

FIELD

The present invention relates to a gabion, especially to a multiple side panelled gabion, which can be extended to increase the cavity area within any single gabion.

BACKGROUND

Gabions are temporary or semi-permanent fortification structures which are used to protect military or civilian installations from weapons assault or from elemental forces, such as flood waters, lava flows, avalanches, slope erosion, soil instability and the like.

WO-A-90/12160 discloses wire mesh cage structures useful as gabions. The cage structure is made up of pivotally interconnected open mesh work frames which are connected together under factory conditions so that the cage can fold concertina-wise to take a flattened form for transportation to site, where it can be erected to take an open multi-compartmental form for filling with a suitable fill material such as sand, soil, earth or rocks.

WO-A-00/40810 also concerns a multi-compartmental gabion which folds concertina-wise for transportation, and which comprises side walls for transportation, and comprises side walls extending along the length of the multi-compartmental gabion. The side walls being connected at spaced intervals along the length of the gabion by partition walls which are formed from two releasable connected sections, which after use of the gabion can be released, the gabion unzipped for recovery purposes.

Existing gabions have certain disadvantages with respect to recoverability. For example, recovery of such gabions can be time consuming, difficult, dangerous, impractical, and damaging to the gabion material, preventing or comprising its reuse, or a combination of any two or more of these. There is a further disadvantage with respect to gabion size. For example, the cavity size within the gabion cannot be adjusted at the site of construction. Although in practice a limited range of standardised cavity sizes meets most requirements, it is still sometimes necessary to custom size for special applications.

Accordingly, there is a need for an improved recoverable gabion. There is a need for an improved multi-compartmental, recoverable gabion having adjustable cavity sizes.

BRIEF DESCRIPTION OF THE DRAWINGS

The invention will now be more particularly described with reference to the following drawings, in which.

DETAILED DESCRIPTION

Figure 1:
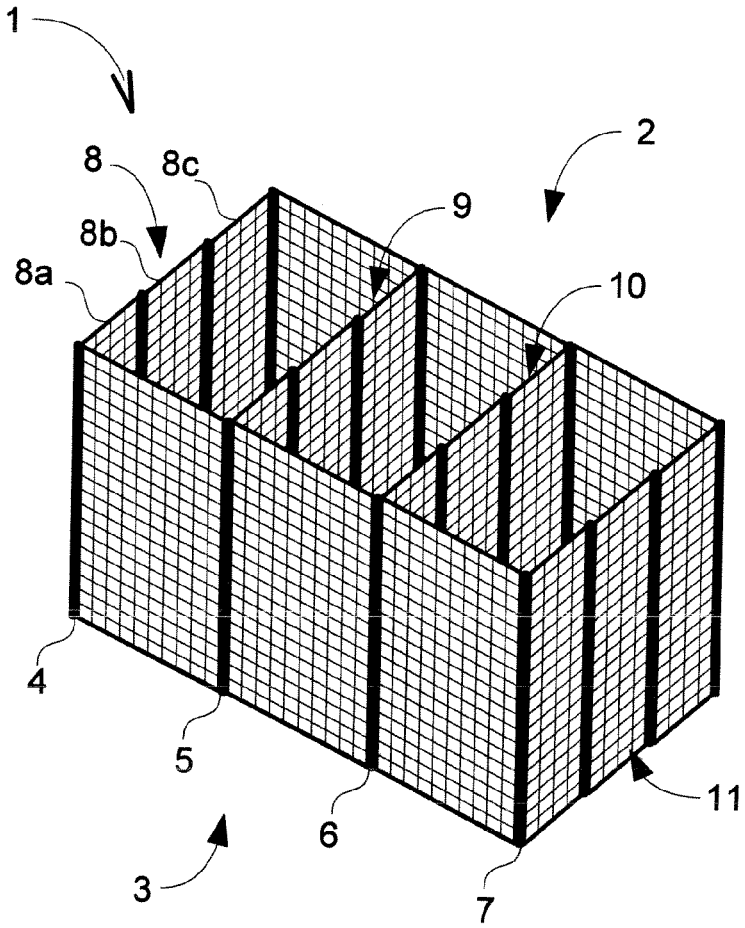
FIG. 1 shows a perspective view of a multi side wall sectioned gabion in accordance with the invention.

According to the present invention, there is provided a gabion comprising opposed side walls connected together at spaced intervals by a plurality of partition walls such that spaces between neighbouring pairs of partition walls define, together with the side walls, individual compartments of the gabion, adjacent side and partition walls being connected to one another by pivotal connections wherein at least one partition wall comprises at least three partition wall elements, a first partition wall element being pivotally connected to a first side wall and a second partition wall element being connected to a second side wall, and the partition wall comprising at least a third partition wall element between said first and second partition wall elements acting as a spacer element therebetween to extend the width of the gabion compartment and being releasably connected to the first and second partition wall elements.

Preferably, the third partition wall element is connected at one of its ends to the first partition wall element, in which case the third partition wall element may be connected at the other of its ends to the second partition wall element. The connection may be direct, or indirect with further spacer elements contributing to the overall length of the partition wall.

Preferably, the releasable pivotal connections enable the length of at least one partition wall to be adjusted by adding or removing one or more third partition wall elements to or from the partition wall.

Accordingly, the present invention provides a gabion comprising opposed side walls connected together at spaced intervals by a plurality of partition walls such that spaces between neighbouring pairs of partition walls define, together with the side walls, individual compartments of the gabion, adjacent side and partition walls being connected to one another by pivotal connections wherein at least one partition wall comprises a plurality of partition wall elements, the partition wall elements in each partition wall being connected to one another by pivotal connections, and wherein at least one of said partition wall element pivotal connections is a releasable connection.

Accordingly, the present invention provides a gabion comprising opposed side walls connected together at spaced intervals by a plurality of partition walls such that spaces between neighbouring pairs of partition walls define, together with the side walls, individual compartments of the gabion, adjacent side and partition walls being connected to one another by pivotal connections wherein at least one partition wall comprises a plurality of partition wall elements, the partition wall elements in each partition wall being connected to one another by pivotal connections, and wherein at least one of said partition wall element pivotal connections is a releasable connection.

Preferably, the releasable pivotal connection(s) enables the length of at least one partition wall to be adjusted by adding or removing one or more partition wall elements to the partition wall. The releasable connection may comprise a hinge member associated with an edge of each adjacent wall to be connected.

Preferably, the pivotal connections enable the gabion to be folded between flattened and deployed configurations.

The pivotal interconnection between connected walls and/or elements may be achieved by providing interconnected walls and/or wall elements with a row of apertures along an interconnection edge thereof and by providing a coil member helically threaded through a plurality of apertures along the interconnected edge. The each hinge member is preferably a helical spring.

Preferably, a single coil member is helically threaded through the connection edge apertures of two or more neighbouring walls, wall section and/or wall elements to achieve pivotal interconnection therebetween.

Preferably, the each releasable connection comprises a releasable locking member releasably securing hinge members of each pivotal connection to one another.

The pivotal interconnection between connected partition wall elements is preferably releasable and is achieved by providing the interconnected partition wall elements with a row of apertures along an interconnection edge thereof and by providing a first coil member helically threaded through a plurality of apertures along the interconnection edge of a first partition wall element a second coil member helically threaded through a plurality of apertures along the interconnection edge of a second partition wall element (connected to the first partition wall element along the interconnection edge) and a releasable locking member threaded through overlapped first and second coil members.

Preferably, the releasable interconnection between at least a plurality of neighbouring partition wall elements is provided by a hinge member therebetween, and a releasable locking member cooperating with the hinge member releasably to secure the connection.

According to the present invention, there is provided a method for adjusting the compartment size of a gabion, comprising releasing at least one releasable partition wall element pivotal connection in at least one partition wall, inserting or removing at least one partition wall element in/from the partition wall, and reconnecting the releasable pivotal connection. Each partition wall in the gabion may be of equal length or of unequal length depending on the conditions in which the gabion is deployed.

Deployment of the gabion of the invention will generally be effected by transporting the folded gabion to a deployment site, unfolding the gabion and filling each individual compartment of the gabion with a fill material. Generally the fill material will be dictated at least partly by the availability of suitable materials at the deployment site. Suitable fill materials include, but are not limited to, sand, earth, soil, stones, rocks, rubble, concrete, debris, snow, ice and combinations of two or more thereof.

There are a number of reasons why it could be desirable to open partition wall sections of the gabion. For example, when the deployed gabion is to be decommissioned, it is often desirable to recover the gabion from the environment or aesthetic reasons, or simply out of consideration for the local population. Recovery of the gabion of the invention is facilitated by opening up all the openable side wall sections of the gabion, at least partly removing the fill material from the compartments, and removing the gabion from site.

Although the invention is characterised by the presence of at least one openable and therefrom extendable partition wall section, and preferably by a plurality of openable partition wall sections, it will often be desirable to provide each individual partition wall section of the gabion, optionally with the exception of the end compartments of the gabion (where the gabion has more than two compartments) with openable partition sections. Accordingly, there is provided in accordance with the invention a multiple partition walled gabion as described wherein the pivotal connection between the connected partition wall elements of each partition wall sections, optionally with the exception of the end partition wall sections, is provided by a hinge member provided between the first partition wall element of a given partition wall section and a second neighbouring partition wall element of the given or a neighbouring partition wall section and a releasable locking member cooperating with the hinge member releasably to secure the pivotal connection. Preferably a first hinge member is provided on the first partition wall element and a second hinge member is provided on the second neighbouring partition wall element, and the releasable locking member cooperates with both first and second hinge members releasably to secure the pivotal connection.

Accordingly, the invention provides a multiple compartmental gabion as described wherein the pivotal connection between the connect partition wall elements of at least a plurality of opposed partition walls is provided by a hinge member provided between a first partition wall element of a given partition wall and a second neighbouring partition wall element of the given partition wall, and by a releasable locking member cooperating with the hinge member releasably to secure the pivotal connection. Also contemplated within the scope of the invention is a multi-compartmental gabion as described wherein the pivotal connection between the connected partition wall elements of at least a plurality of opposed partition walls is provided by a first hinge member provided on a first partition wall element of a given partition wall and by a second hinge member on a second partition wall element of the given partition wall and by a releasable locking member connecting the first hinge member to the second hinge member.

A partition wall preferably comprises two or more partition wall elements. However, a side wall section, a plurality of side wall sections, or each side wall section may, if desired comprise more than two side wall elements. In this case pivotal connections are preferably provided between each side wall element.

Accordingly, the invention provides a multi-compartmental gabion as described wherein one or more partition wall sections comprise a single partition wall element. The invention also provides a multi-compartmental gabion as described wherein one or more partition wall sections comprise two partition wall elements pivotally connected together (preferably openably pivotally connected together). Also contemplated within the scope of the invention is a multi-compartmental gabion as described wherein one or more partition wall sections comprise more than two partition wall elements, with pivotal interconnections being provided between each neighbouring pair of partition wall elements.

The multi-compartmental gabion of the invention comprises a plurality of connected compartments, each compartment being bounded at opposed sides by a pair of opposed side wall sections and being bounded at opposed ends by a pair of opposed side partition walls, each partition wall section comprising one or more partition wall elements. In at least one, two, three or more individual compartments of the multi-compartmental gabion at least one such partition wall element is arranged to be openable, the mechanism of opening being operable when the compartment is loaded with a fill material.

In one preferred embodiment of the invention the pivotal interconnection between connected walls and/or wall sections and/or wall elements is achieved by providing interconnected walls, wall sections and/or wall elements with a row of apertures along an interconnection edge thereof and by providing a coil member helically threaded through a plurality of apertures along the interconnected edge. In case of a straightforward (i.e.—non-openable) pivotal connection, a single coil member may be helically threaded through the connection edge apertures of two (or more) neighbouring walls, wall sections and/or wall elements to achieve pivotal interconnection therebetween. Accordingly, there is provided in accordance with the invention a multi-compartmental gabion as described wherein at least one pivotal connection is provided by the presence of a coil member helically threaded through connection edges apertures of connected walls, wall sections or wall elements.

In another preferred embodiment of the invention, the openable pivotal interconnection between connected partition wall elements is achieved by providing the interconnected partition wall elements with a row of apertures along an interconnection edge thereof and by providing a first coil member helically threaded through a plurality of apertures along the interconnection edge of a first partition wall element, a second coil member helically threaded through a plurality of apertures along the interconnection edge of a second partition wall element (connected to the first partition wall element along the interconnection edge) and a releasable locking member threaded through overlapped first and second coil members. Thus, in this case of an openable pivotal connection, a pair of coil members may be helically threaded through the respective opposed connection edge apertures of two neighbouring partition wall elements, and a releasable locking member inserted through the overlapped coils of the opposed pair of coil members. Accordingly, there is provided in accordance with the invention a multi-compartmental gabion as described wherein at least one openable pivotal connection between neighbouring partition wall elements is provided by the presence of a pair of coil members helically threaded through respective connection edge apertures of neighbouring partition wall elements and by a releasable locking member threaded through the respective coil members when overlapped.

Thus there is provided in accordance with the invention a multi-compartmental gabion as described wherein at least one hinge member comprises a helical coil.

The releasable locking member may be of a suitable shape or size and may for example comprise an elongated locking pin. The pin may be provided with a gripping protrusion at one end to facilitate manual insertion and/or removal of the locking pin. The gripping protrusion may for example comprise a loop at one end of the locking pin. Accordingly, there is provided in accordance with the invention a multi-compartmental gabion as described wherein at least one locking member comprises an elongated locking pin.

The side walls, side wall sections partition walls and/or partition wall elements preferably comprise one or more panel sections of any suitable material, for example steel, aluminium, titanium, any other suitable metal or alloy, or from a plastics, ceramic or natural material such as timber, sisal, jute, coir or seagrass. Normally, steel is preferred, in which case the steel is preferably treated to prevent or hinder steel erosion during development of the gabion. The panel may be closed panel or may be mesh panel. In the case of a closed panel, connection edge apertures where needed will normally be machined or otherwise provided in the panel edge. In the case of a mesh panel the mesh apertures may serve as connection edge apertures where needed.

Preferably, the multi-compartmental gabion of the invention comprises a cage structure.

Also preferably, the gabion comprises pivotally interconnected, preferably open meshwork, panels which are connected together under factory conditions so that the gabion can take a flattened form for transportation to site where it can be erected to take a form in which panels thereof define side, partition and end walls and an open top through which the compartments of the gabion may be filled. Preferably, under factory conditions said panels define side, partition and end walls and are pivotally interconnected edge to edge and are relatively foldable to lie face to face in the flattened form for transportation to site and can be relatively unfolded to bring the gabion to the erected condition without the requirement for any further connection of the side, partition of end walls on site.

The invention will now be more particularly described with reference to the following drawings.

Figure 2:
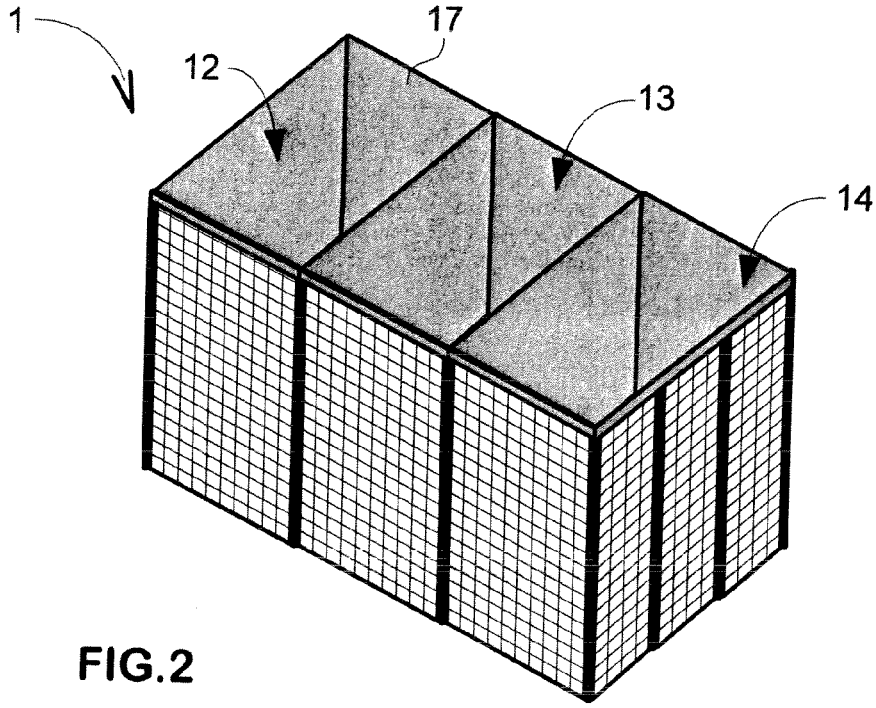
FIG. 2 shows the multi side wall sectioned gabion of FIG. 1 lined with a geotextile material.

Referring in more detail to FIGS. 1 and 2, there is shown a multiple partition wall section gabion 1 comprising opposed side walls 2, 3 comprising multiple side wall sections 2*a*, 2*b*, 2*c*, 3*a*, 3*b*, 3*c*. The opposed side walls 2, 3 are connected together at spaced intervals by pivotal hinges 4, 5, 6, 7 along the length of gabion 1 by a plurality of partition walls 8, 9, 10, 11 defining, together with the side walls 2, 3, individual compartments 12, 13, 14 of the gabion 1. In these figures, only three compartments are shown, but it is clear that the gabion can comprise any number of compartments to form gabions of a variety of lengths to suit the circumstances.

Each partition wall 8, 9, 10, 11 comprises a plurality of partition wall elements 8*a*, 8*b*, 8*c* (repeated for each partition wall) with openable pivotal connections being provided between neighbouring partition wall elements 8*a*, 8*b*, and between neighbouring partition wall elements 8*b*, 8*c*.

Referring to FIG. 2, multiple partition wall sectioned gabion 1 is shown lined with geotextile liner 17. The lining material of geotextile liner 17, is of any suitable material, for example woven or non-woven synthetic materials; fibreglass, sisal, jute, coir. In the embodiment shown in FIG. 2, the said lining material is the known geo-textile, material sold by Dupont, and which is designed to allow water to pass through the material, but to prevent solid particles which are in a pasty condition from exuding through the material, even although pressed strongly against. Geo-textile liner 17 may conveniently be folded over the top most edges of the gabion panels and stapled in place (the stapling is not shown in FIG. 2).

The individual compartments 12, 13, 14 of multiple partition wall sectioned gabion 1 can be filled with fill material. The fill material may be selected from any suitable available material, as hereinbefore described, for example rough earth and stones.

Figure 3A:
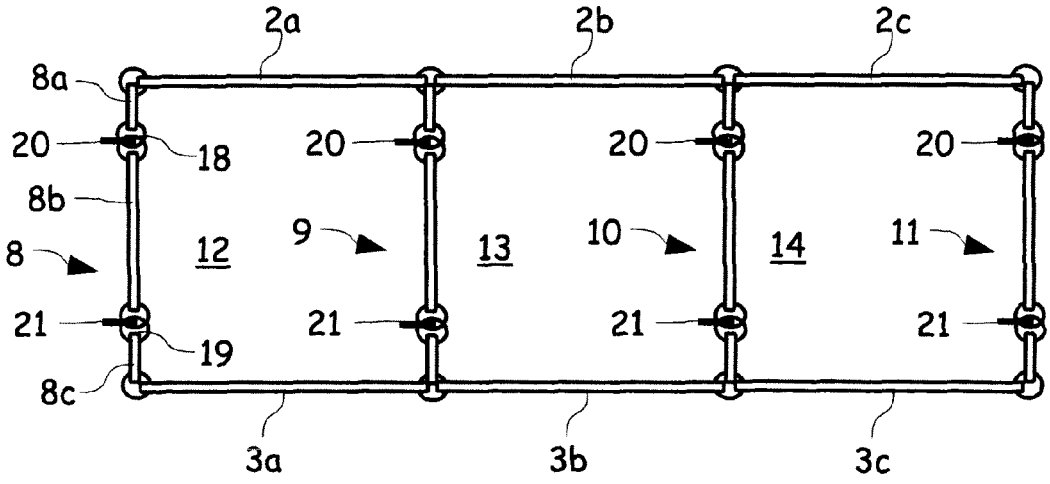
FIG. 3 shows a schematic plan view of the multi side wall sectioned gabion of FIG. 1 in an expanded configuration (FIG. 3*a*), with one side wall opened (FIG. 3*b*), and having additional side wall elements (FIG. 3*c*)
Figure 3B:
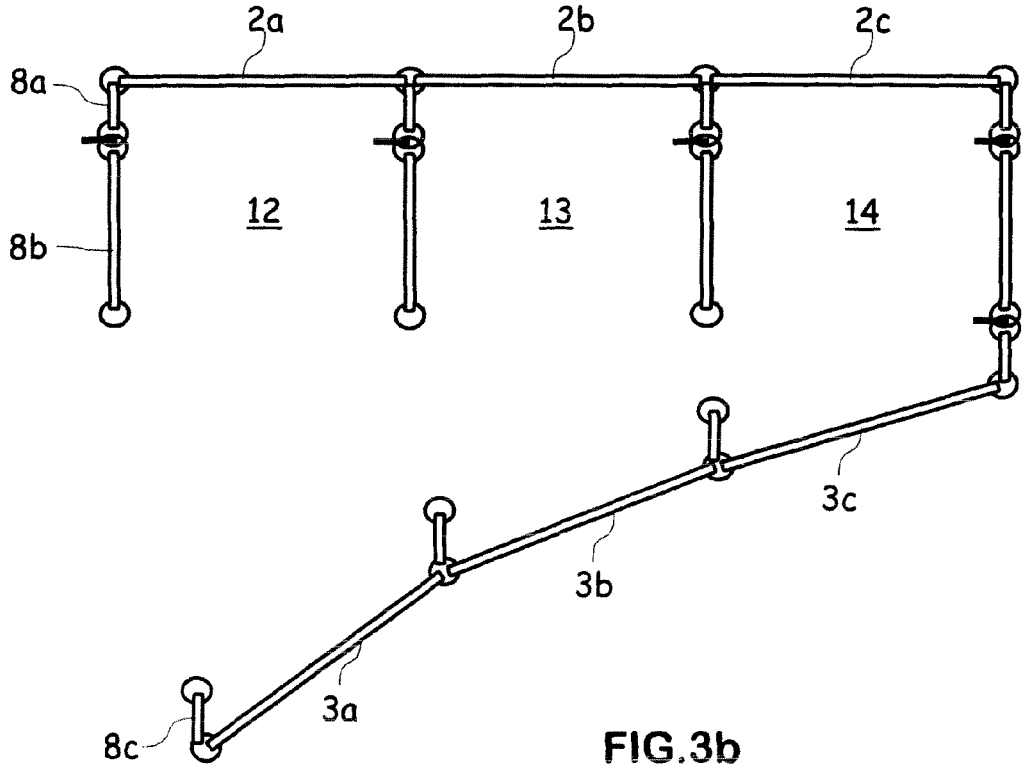
Figure 3C:
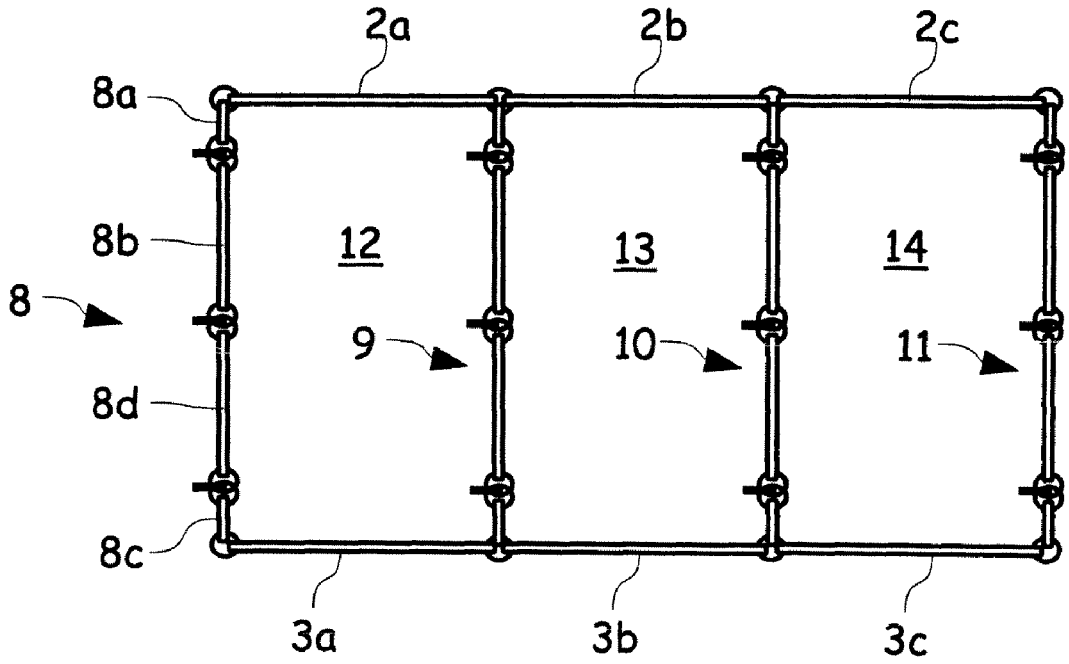

Referring to FIG. 3*a* there is shown in schematic plan view a multi-compartmental gabion 1 comprising opposed side walls 2, 3 connected together at spaced intervals along the length of the gabion 1 by a plurality of partition walls 8, 9, 10, 11 defining, together with side walls 2, 3, individual compartments 12, 13, 14. Each partition wall 8 (and other similar partition walls) comprises two end partition elements 8*a*, 8*c* and a middle partition element 8*b*, where the first end of the end partition elements 8*a*, 8*c* are pivotally connected to the respective side wall 2, 3. The second ends of each end partition element 8*a* 8*c* are connected by openable pivotal connections 18, 19, secured by locking pins 20, 21 to the first and second end of the middle partition element 8*b* respectively. FIG. 3*b* shows the gabion 1 when locking pins 21 are removed and the side wall 3 is moved pivotally away from the opposing side wall 2 to open the gabion 1 compartments 12, 13, 14 from the side allowing access to the contents of the compartments. FIG. 3*c* shows how an additional partition elements 8*d*, 9*d*, 10*d*, 11*d* can be inserted into each partition wall 8, 9, 10, 11 to extend the length of the partition wall and thereby increase the size of the compartments 12, 13, 14. The additional partition element 8*d* (and other similar partition elements) in this example is inserted between the middle partition element 8*b* and the second end partition element 8*c*.

It is obvious to the skilled person that, according to the present invention, each partition wall may comprise any number of partition wall sections to suit the deployment requirements of each gabion 1, or even the requirements of each compartment in a gabion 1.

The ability to remove a side wall from the gabion 1 can also be advantageous during both the deployment and retrieval of the gabion 1, whereby a part or a whole side wall may be removed from the gabion 1 in a single motion.

Figure 4:
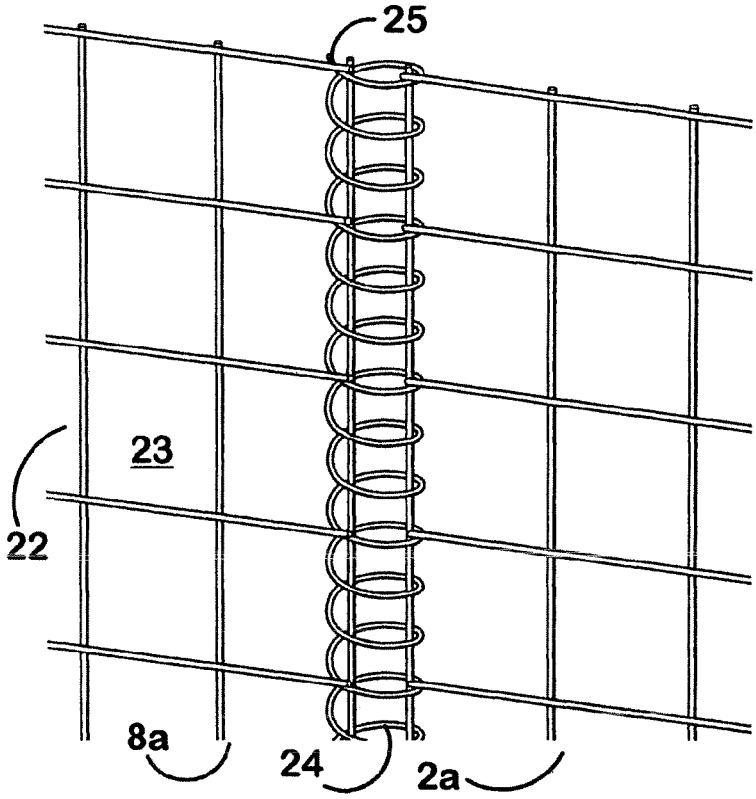
FIG. 4 shows in close-up perspective view the pivotal connection between neighbouring side wall elements of the gabion of FIGS. 1 to 3*c;*

Referring now to FIG. 4, there is shown a close up perspective view of the pivotal connection between partition wall element 8*a* and side wall section 2*a*. Referring to FIG. 4, partition wall element 8*a* comprises an open mesh work panel 22 comprising a mesh work lattice of square apertures 23. Although the entire partition wall element is not shown in FIG. 4, the expanded view shows clearly the neighbouring mesh work frames of neighbouring partition wall element 8*a* and side wall section 2*a*. Pivotal connection therebetween is affected by helical coil 24 which is helically threaded through the mesh apertures of the neighbouring panels. Although not shown in FIG. 4, loose end 25 of helical coil 24 may be bent round or otherwise prevented from accidentally disengaging with the top most mesh aperture of partition wall element 8*a* and side wall section 2*a*.

Figure 5:
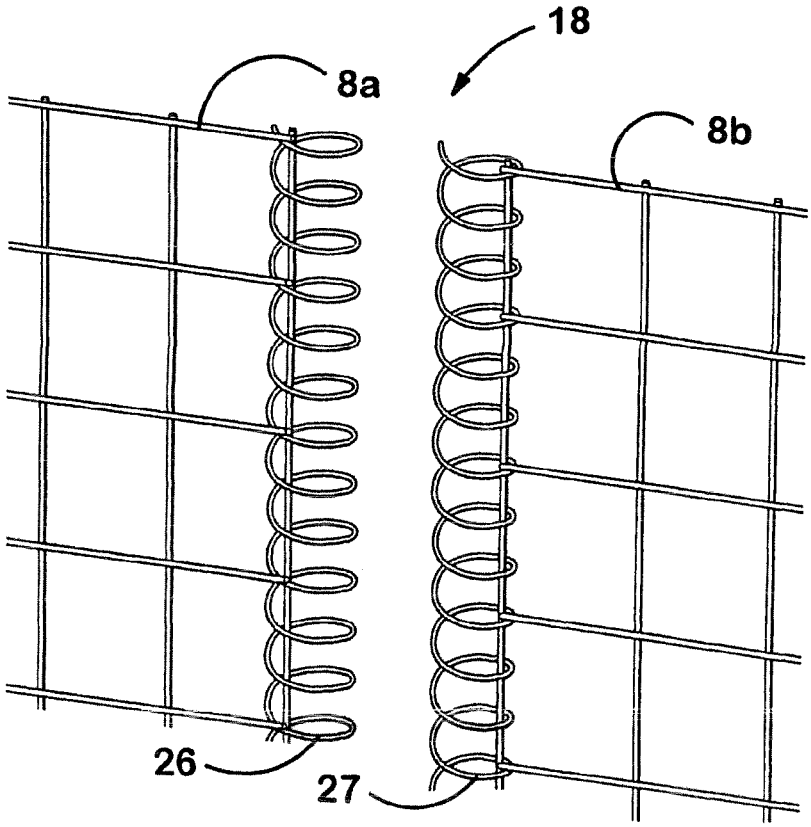
FIG. 5 shows in close-up perspective view the openable pivotal connection between neighbouring side wall elements of the multiple side wall sectioned gabion of FIGS. 1 to 3*c* before the releasably locking member is installed.
Figure 6:
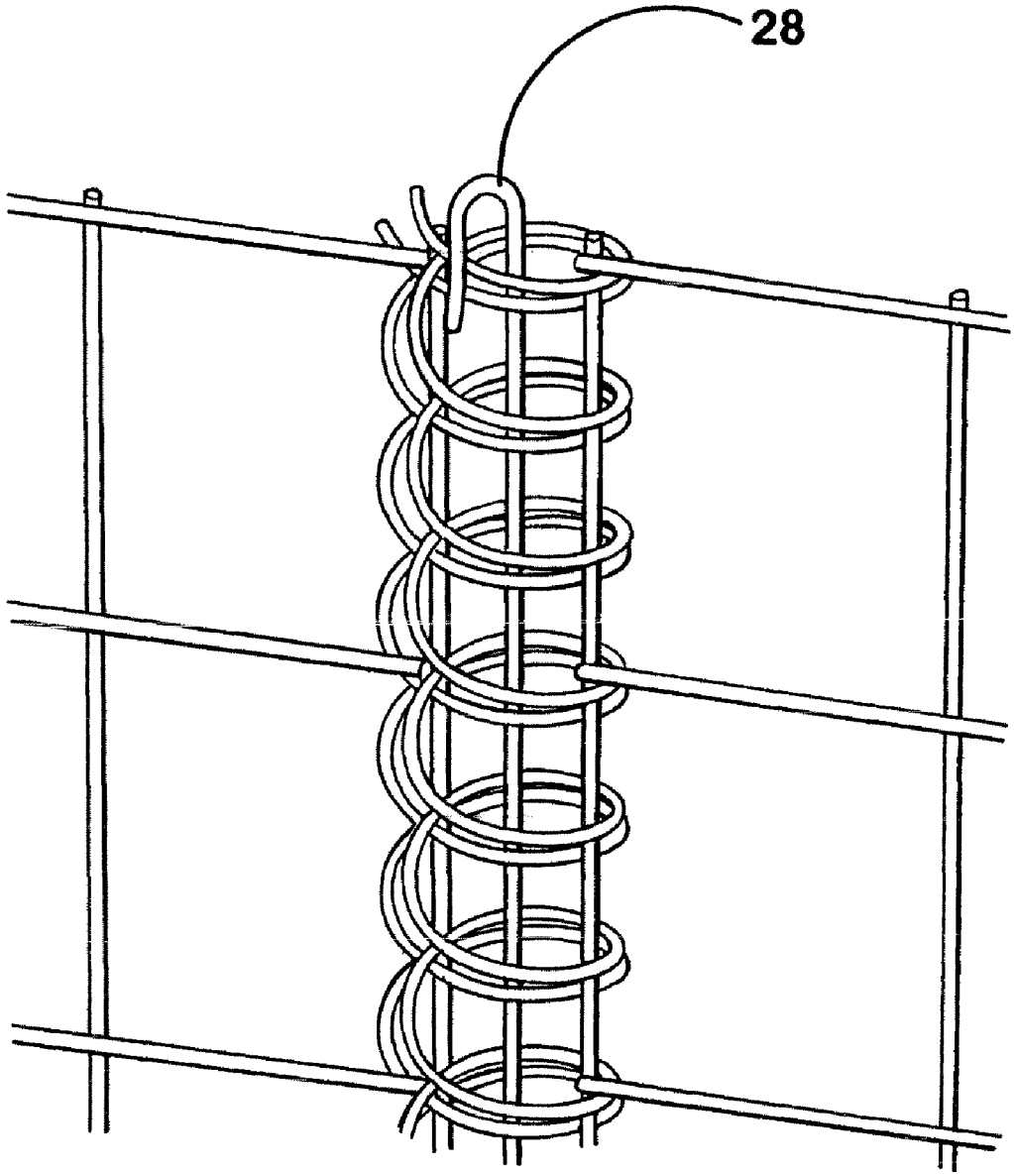
FIG. 6 shows in close-up perspective view the operable pivotal connection between the components of the FIG. 5 drawing.

Referring now to FIG. 5, there is shown in close-up perspective view the openable pivotal connection 18 between neighbouring partition wall elements 8*a*, 8*b*. In this case, both neighbouring mesh work panels are provided with helical coil members threaded helically through the mesh work panel apertures thereof. The first hinge member 26 and second member 27 are thereby provided. The connected and releasably locked equipment is shown in FIG. 6, locking being effected by releasable locking pin 28.

Figure 7:
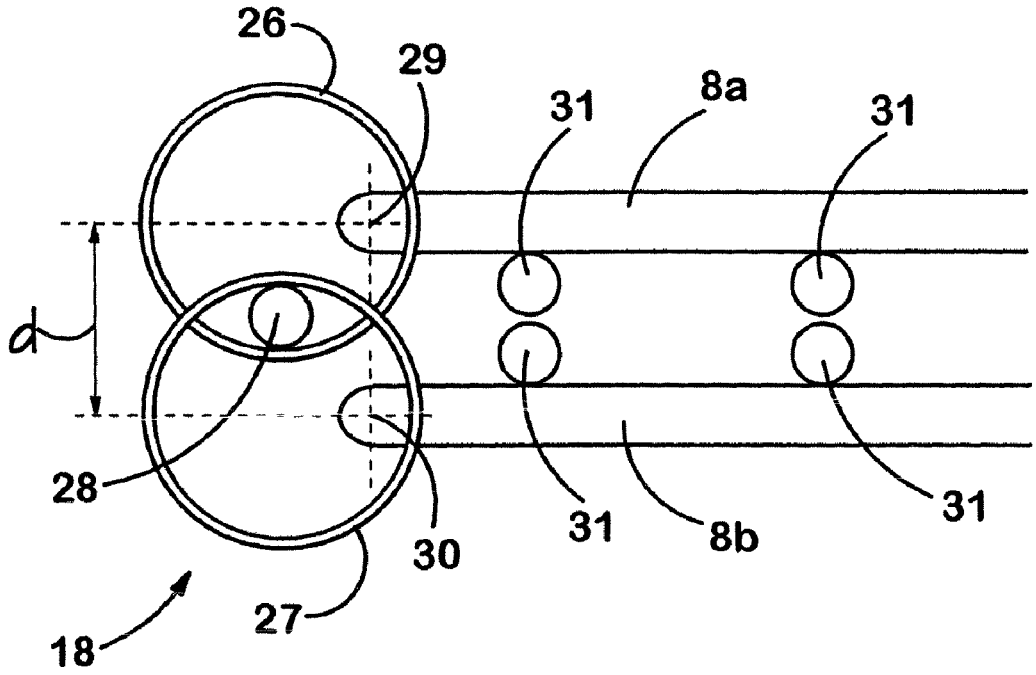
FIG. 7 shows in close-up schematic plan view the pivotal connection between wall elements folded substantially flat for storage.

FIG. 7 shows how the gabion can be folded substantially flat for storage. The pivotal connection 18 between adjacent, say, partition wall elements 8*a*, 8*b* consists of a pair of helical springs 62, 27 connected by way of a connection member 28 as previously described. This arrangement means that the partition wall elements 8*a*, 8*b* pivot about pivot axes 29, 30 that are spaced apart by a distant d. Distance d is greater than the thickness of the side walls 9*a*, 8*b* and any protuberances (e.g. vertical wire members 31) such that the side wall elements 8*a*, 8*b* can he in a face-to-face relationship to one another.

The pivotal connections between the side wall sections and the partition wall elements could also be made openable to allow access to each compartment individually.

The invention claimed is:

1. A method for adjusting the width of a gabion comprising opposed side walls connected together at spaced intervals by a plurality of partition walls such that spaces between neighbouring pairs of partition walls define, together with the side walls, a plurality of individual compartments of the gabion, adjacent side and partition walls being connected to one another by pivotal connections, wherein at least one partition wall having a first length comprises a plurality of partition wall elements connected together by pivotal connections, and at least one of the partition wall element connections comprises a releasable connection;

the method comprising the steps of;

releasing a first releasable partition wall element pivotal connection in at least one partition wall;

inserting or removing at least one partition wall element in the partition wall; and reconnecting the releasable pivotal connection to a second pivotal connection, the adjusted partition wall having a second length different to the first length, and independent to the length of any other partition wall.

2. The method according to claim 1, wherein the inserting or removing step comprises inserting at least one partition wall element in the partition wall.

3. The method according to claim 1, wherein the inserting or removing step comprises removing at least one partition wall element from the partition wall.

4. The method according to claim 1, wherein the at least one partition wall comprises at least three partition wall elements, a first partition wall element being pivotally connected to a first side wall and a second partition wall element being connected to a second side wall, and a third partition wall element between said first and second partition wall elements acting as a spacer element therebetween to extend the width of the gabion compartment and being releasably connected to the first and second partition wall elements and being removable independently to any other third partition wall elements.

5. The method according to claim 4, wherein the third partition wall element is connected at one of its ends to the first partition wall element.

6. The method according to claim 5, wherein the third partition wall element is connected at the other of its ends to the second partition wall element.

7. The method according to claim 4, wherein the third partition wall element is connected directly to the first partition wall element.

8. The method according to claim 4, wherein the third partition wall element is indirectly connected to the first partition wall element, with one or more further spacer elements therebetween.

9. The method according to claim 4, wherein the third partition wall element is connected directly to the second partition wall element.

10. The method according to claim 4, wherein the third partition wall element is indirectly connected to the second partition wall element, with one or more further spacer elements therebetween.

11. The method according to claim 1, wherein the releasable pivotal connections enable the length of at least one partition wall to be adjusted by adding or removing one or more partition wall elements to or from the partition wall.

12. The method according to claim 1, wherein the pivotal connections enable the gabion to be folded between flattened and deployed configurations.

13. The method according to claim 1, wherein the releasable connection comprises a hinge member associated with an edge of each adjacent wall element to be connected.

14. The method according to claim 1, wherein the pivotal interconnection between connected walls and/or elements is achieved by providing interconnected walls and/or wall elements with a row of apertures along an interconnection edge thereof and by providing a coil member helically threaded through a plurality of apertures along the interconnected edge.

15. The method according to claim 14, wherein a single coil member is helically threaded through the connection edge apertures of two or more neighbouring walls, wall section and/or wall elements to achieve pivotal interconnection therebetween.

16. The method according to claim 13, wherein each hinge member is a helical spring.

17. The method according to claim 13, wherein the each releasable connection comprises a releasable locking member releasably securing hinge members of each pivotal connection to one another.

18. The method according to claim 13, wherein the pivotal interconnection between connected partition wall elements is releasable and is achieved by providing the interconnected partition wall elements with a row of apertures along an interconnection edge thereof and by providing a first coil member helically threaded through a plurality of apertures along the interconnection edge of a first partition wall element with a second coil member helically threaded through a plurality of apertures along the interconnection edge of a second partition wall element and a releasable locking member threaded through overlapped first and second coil members.

19. The method according to claim 1, wherein the releasable interconnection between at least a plurality of neighbouring partition wall elements is provided by a hinge member therebetween, and a releasable locking member cooperating with the hinge member releasably to secure the connection.

20. The method according to claim 19, wherein the releasable interconnection between each neighbouring partition wall element is provided by a hinge member therebetween, and a releasable locking member cooperating with the hinge member releasably to secure the connection.

21. The method according to claim 1, wherein each partition wall is equal in length.

22. A method for setting up a barrier against weapons assault or elemental forces, comprising: deploying the gabion of claim 1, and filling each individual compartment with a fill material.

* * * * *